US006359246B1

(12) United States Patent
Essig et al.

(10) Patent No.: US 6,359,246 B1
(45) Date of Patent: Mar. 19, 2002

(54) PROCESS AND DEVICE FOR SEPARATING BROKEN BEANS AND SHELLS

(75) Inventors: Joachim Essig, Heubach; Olaf Oehmichen, Essingen, both of (DE)

(73) Assignee: F. B. Lehmann Maschinenfabrik GmbH, Aalen (DE)

( * ) Notice: Subject to any disclaimer, the term of this patent is extended or adjusted under 35 U.S.C. 154(b) by 0 days.

(21) Appl. No.: 09/376,204

(22) Filed: Aug. 18, 1999

(30) Foreign Application Priority Data

Aug. 19, 1998 (DE) ..... 198 37 635
Mar. 19, 1999 (DE) ..... 199 12 462

(51) Int. Cl.[7] ..... B03C 7/00
(52) U.S. Cl. ..... 209/127.1; 209/127.4; 209/128; 209/129; 209/130; 209/127.3
(58) Field of Search ..... 209/127.1, 127.4, 209/127.3, 128, 129, 130

(56) References Cited

U.S. PATENT DOCUMENTS 668,791 A * 2/1901 Blake et al.
2,135,716 A 11/1938 Johnson
2,615,570 A * 10/1952 Morrison
2,803,344 A * 8/1957 Morrison
5,098,558 A * 3/1992 Knoll et al. ..... 209/127.3
5,118,407 A * 6/1992 Beck et al. ..... 209/2
5,161,696 A * 11/1992 Seider ..... 209/127.4
5,251,762 A * 10/1993 Taylor et al. ..... 209/127.4
5,542,543 A * 8/1996 Yasukuni ..... 209/127.1

FOREIGN PATENT DOCUMENTS

DE 19 07 880 A 7/1970

* cited by examiner

*Primary Examiner*—Donald P. Walsh
*Assistant Examiner*—Jonathan R Miller
(74) *Attorney, Agent, or Firm*—Ware, Fressola, VanDerSluys & Adolphson LLP

(57) ABSTRACT

The invention concerns a process as well as an apparatus for separating broken goods, consisting of broken nibs or beans and their shells and especially the separation of broken cacao beans (nibs) from the cacao shells in an electrostatic manner. In this connection the broken goods are electrostatically charged in fractionated configuration within a charging area between two differently charged electrodes and thereafter the beans and shells are differently deflected on downfalling within a homogeneous electrical field generated by two other electrodes defining the downfall section. The broken beans and shells then separated by means of a mechanical separator into two different product streams, consisting essentially of a stream of broken nibs and a stream of shells, which product streams are then removed. Excellent results in separating the above mentioned particles are gained using a relatively small and inexpensive equipment, when such results could up to now only be received by means of costly winnowing machines.

22 Claims, 2 Drawing Sheets

PROCESS AND DEVICE FOR SEPARATING BROKEN BEANS AND SHELLS

BACKGROUND OF THE INVENTION

The invention concerns a process and a device for separating broken materials consisting of broken corns or beans and their shells, especially for the separation of broken cacao beans, so-called nibs, from the cacao bean shells.

As used herein, the term "broken goods" and "broken materials" shall mean fractionated agricultural products of the type having an inner bean (or other meat) covered by shells (or skins or husks) which must be separated. Although applicable to a range of such products including, for instance, corn, the invention will be described with particular reference to cacao beans. Fractionated cacao beans with a maximum of about 2% shells are referred to as "nibs", and fractionated shells are referred to as "shells".

Cacao beans exiting, depending on the kind of their preparation, from a roasting plant, sterilization plant or pre-drying plant are usually broken or fractionated in a reflex breaker. The fractions of broken cacao beans, the so-called nibs, arising from that kind of preparation, as well as shells have then to be separated from one another so that the nibs can be further treated. The accuracy of separation must be as great as possible, as it influences essentially the quality of the manufactured cacao mass. At maximum 2% shells are allowed within the nibs in accordance with certain regulations. Moreover, the portion of shells within the nibs should be as small as possible resulting in an essential improvement of the operation time of the following grinding station.

Up to now the nibs are separated from the shells by screening into different fractions and by subsequent sifting the several fractions. In a special plant of the assignee the cacao beans are for that reason automatically delivered from preceding machines to a large preceding screen and are thereafter fed to the breaking station and grading station. The cacao beans broken in a rotating double disk breaker are separated in a classifying apparatus into six fractions. The mixture of shells and nibs exit laterally from the screen box in trajectories of parabolic flows separated into fractions to a separate vertical sifter. An adjusted air stream which is coordinated with the nib size of each fraction achieves a good separation of the specifically heavy nibs from the specifically lightweight shells on the principle of counter-flow sifting. The grading station is provided with five cascade-shaped screens arranged one behind the other, which separates the broken cacao beans into six fractions from coarse to fine. The applied coarse to fine sift principle resulting by means of short paths of the main quantity in short contact times and provides advantages in microbiological and hygienic aspects. The sifting of the individual fractions takes place in six laterally arranged vertical sifters. By reason of the fine distribution of the sifting into six fractions, a higher separating effect at a more precise screening is achieved at a high through-put rate. The air velocity of each sifter can be adjusted to the optimum separating effect. The shell fractions are thereafter drawn upwardly, separated from the air in six shell separators and extracted via a common shell trap. The nibs fall downwardly into a vibratory discharge channel. The above mentioned plant, however, has certain disadvantages in constructional and operational aspects, although the results concerning the classification of the broken beans into fractions as well as the separation of the shells from the nibs are rather good.

SUMMARY OF THE INVENTION

Therefore, it is an object underlying the invention to further improve the above mentioned process and apparatus for separating broken materials, especially broken beans of cacao, i e., so-called nibs, from the shells of those beans, and to minimize in this respect the cost of the apparatus and machines necessary, resulting, however, in a separation rate which is at least so high as for the prior art process and apparatus.

These and other objects are advantageously solved by a first combination of steps of the process according to which the separation of the broken goods is accomplished electrostatically by electrically charging the broken goods in a fractionated configuration within a charging area between two differently charged electrodes and thereafter by directing the electrostatically charged fractionated broken goods in a free downfall in another homogenous electrical field provided by two other electrodes defining the way of downfall of the broken goods, resulting in the broken goods being at least partly differently deflected and thereby also separated, so that the nibs are separated from the shells, and are thereafter by means of a mechanically operating separator collected and delivered in two different product streams, consisting essentially of a stream of nibs and a stream of shells.

The basic of the invention is that the separation is accomplished electrostatically in one or several steps by charging the particles of the broken goods in a homogeneous electrical field and thereafter deflecting the charged particles in another electrical field by forces which are proportional to the specific charge. This idea is based on the known fact that the size of the particles influence the separation insofar as with increasing particle size the ratio of surface to volume becomes more and more unfavorable and thus the specific charge will be smaller. The electric conductivity, too, of the particles, has influence in this connection as it is the physical parameter defining the rate at which the particles are changed. Moreover, it must be considered that the shells and nibs have in general the same specific gravity, so that a different deflection of particles having the same size can only be expected if during the charging the particles are provided with different charges.

Considering the above mentioned physical facts and according to an especially advantageous embodiment of the process of the subject invention, the fractionated broken goods are subjeted to vibratory movement during the charge transfer from the charged electrodes to the broken good as they pass through the charging area to the area of free downfall, and the vibratory movement can be controlled in order to adjust the length of stay of the broken goods within the charging area and thus the duration of charging. The broken goods are deflected within the area of free downfall, in accordance with the amount of charge they received in the charging area and thus the quantity of charge the broken goods have for deflecting the broken goods toward the cathode one of the electrodes which is connected to ground. During said deflection, part of the more light-weight (lighter) and smaller particles of the broken goods are so strongly deflected in the area of free downfall that this part passes through apertures provided in the cathode and is fed behind these apertures through a channel to a product stream of shells.

Moreover, it is advantageous to control the moisture content of the stream of broken goods before the charging area to the requirements of the electrical charging of the particles of the broken goods, as the conductivity of the material can change dependent on the content of moisture and particles with different moisture content will therefore be differently deflected.

Furthermore, to optimize charging and separation of the broken goods thereafter into, larger, heavier and smaller, lighter portions, a vibratory or shaking means is used within the charging area adjacent to the electrodes. This results in most of the particles of the broken goods being spread to be positioned in a one-nib-layer only, as in the case that several particles are positioned one over the other in several layers the charging can be hindered because no direct contact between the upper most positioned particle and the charged surface of the apparatus will then be provided.

The apparatus for providing the process according to the subject invention is characterized generally by a charging area for the electrical charging of the broken goods which is to be separated, moreover by a deflection area adjacent thereto for the deflecting the charged broken goods during a free downfall, and by a separating area connected thereto for the separation of the at less deflected heavier particles of the broken goods from the more deflected light particles as well for the removal of the separated broken good.

In this connection it has been found advantageous to configure the charging area such that it is provided with at least a feeding hopper for the broken goods which is to be separated and with at least a vibratory chute adjacent thereto and being in feeding connection with said hopper, which chute is provided with differently charged electrodes between which the broken goods which are to be separated are moved through in order to become electrically charged. The deflecting area is provided with at least two further electrodes defining the free downfall section, and a separation area joining the deflection area is provided with at least one adjustable mechanical separator which is connected to a transporting system for the separated product streams, consisting of nibs or heavier particles of the broken goods and shells of cacao beans or lighter particles of broken goods.

One of the two electrodes defining the deflection area is advantageously a cathode connected to ground and is provided with several apertures having flaps for the further deflection of the deflected shells of the cacao beans, behind with apertures a channel is provided connected to a transport system for the removal of the shells of the cacao beans, i.e. the smaller, lighter particles of the broken goods.

Moreover, it is advantageous to configure one of the two electrodes connected to the vibratory chute to become a cathode connected to ground, which cathode supports the transfer of the charge to the particles of the broken goods, whereas the vibratory chute is completely electrically insulated to the outside and is connected to same voltage as one of the electrodes. Those electrodes related to the vibratory chute may advantageously consist of plastic material covered by metal or may advantageously be embedded into the chute such that the one electrode is located in the bottom of the chute and the other one is distantly positioned above the bottom so that the charged broken goods can be fed through between the electrodes. The anode of the two electrodes is connected to a positive or negative DC voltage.

According to another aspect of the invention the vibratory chute may be provided with an adjustable vibratory drive and the level of the feeding hopper may also be adjusted in order to make the feeding height considerably variable.

Moreover, according to a further aspect of the invention the inner wall of the vibratory chute may be provided with contours supporting the particles of the broken goods during their movement over these contours, which may be configured in form of pro-tuberances.

According to a further aspect of the invention the two electrodes of the apparatus defining the downfall section of the deflecting area may be configured as condenser plates and may be provided with an electrically insulating layer of material in order to avoid a possible change of charge if the electrodes contact particles of the broken goods.

As discussed above in describing the process of the invention, the apparatus can be provided with means for controlling moisture content of the broken goods in order to provide a uniform degree of moisture in the broken goods, as the efficiency of transfer of the charge is dependent inter alia on the moisture content.

Concluding the above mentioned advantageous embodiments of the invention, it must be stressed that in case the entire apparatus should operate under special climate conditions, it has been found advantageous to enclose the apparatus in a housing. Multiple separating means can be located serially one behind the other or operated in parallel in the housing or enclosure.

The above mentioned objects of the subject invention are also advantageously carried out by a second combination of steps of the process, according to which the broken goods are separated electrostatically by charging them in fractionated configuration within a charging area between two differently charged electrodes and is simultaneously subjected to a vibrational movement, the intensity of which is controlled in order to adjust the charging time of the broken goods, especially broken cacao beans and cacao bean shells.

According to further advantages of the process the fractionated, electrically charged broken goods are separated through the vibrational movement by means of a suction airflow applied to the broken goods, thus that the shells are suctioned off the broken goods. The shells are then separated from the air within a cyclone-separator, whereas the nibs are delivered in a separated product stream.

In order to further optimize the separation of the broken goods, the broken goods are electrically charged within the charging area by the electrodes within a vibration apparatus such that the shells are lifted over the bottom of said vibration apparatus and are then suctioned off by means of a suction apparatus, whereas the broken nipbs remain essentially on the bottom of said vibration apparatus where they are moved to the outlet end of said vibration apparatus because of the vibratory movement.

The apparatus for providing the process of the subject invention according to the above mentioned second combination of steps is characterized by a charging area for the electrical charging of the broken goods to be separated, comprising at least one hopper receiving the broken goods to be separated and at least one vibratory chute joining the hopper for feeding the broken goods, which chute is provided with the differently charged electrodes, a positively charged anode and a cathode connected to ground generating a homogeneous electrical field, between which the broken goods which are to be separated atre passed in order to become electrically charged, moreover comprising a deflection area provided with a suction apparatus for the lighter shells of the broken goods, and further comprising a separating area for the separation of the shells from the stream of suctioned-off air provided with at least one apparatus for winnowing shells from the air.

In this connection it is essentially advantageous to provide the suction apparatus with at least one hood positioned over a perforated plate being the cathode connected to ground within the area of the roof of the vibratory chute, which hood is joined through a suction tube to the winnowing apparatus in form of a cyclone, connected through a discharge air tube to a suction fan and provided at its lower end with a receiving container for the separated shells.

Other and more specific objects and features of the invention herein will appear from the following detailed description and claims, taken together with the drawings.

DETAILED DESCRIPTION OF THE INVENTION

Figure 1:
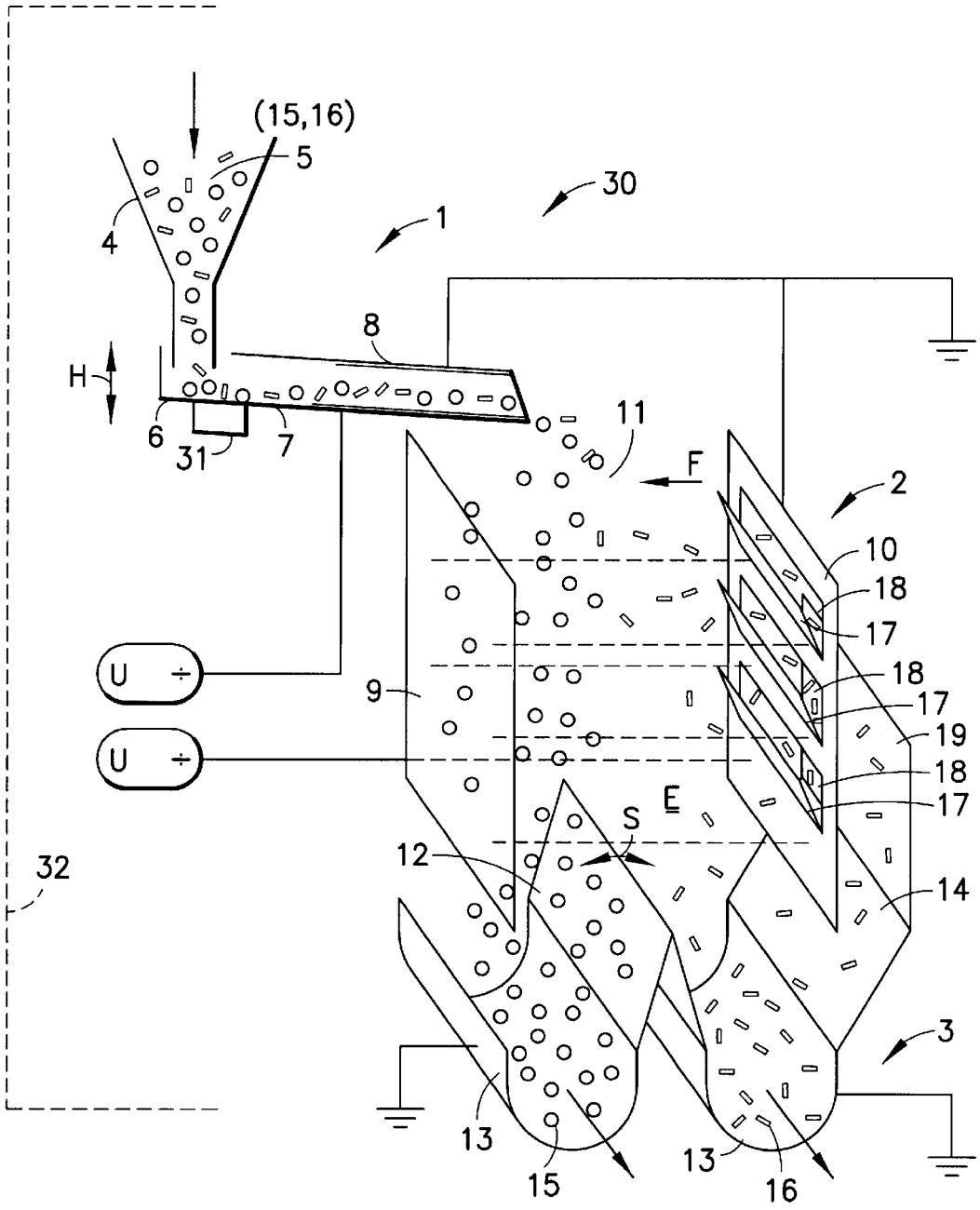
FIG. 1 is a schematic view of apparatus for separating broken goods, according to the invention herein.

The invention is described below on the basis of two embodiments shown schematically in FIGS. 1, 1A and 2 of the drawing concerning the construction of the separating apparatus for accomplishing the process of separating broken goods consisting for instance of beans and their shells or nibs and their shells.

Figure 1A:
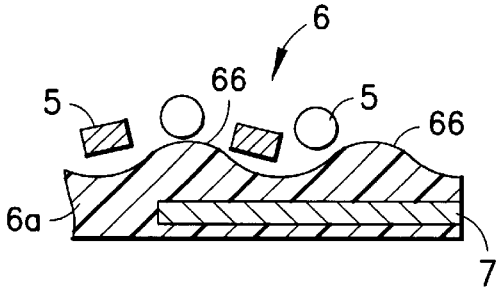
FIG. 1A is an enlarged segmental portion of a chute of the apparatus of FIG. 1.
Figure 2:
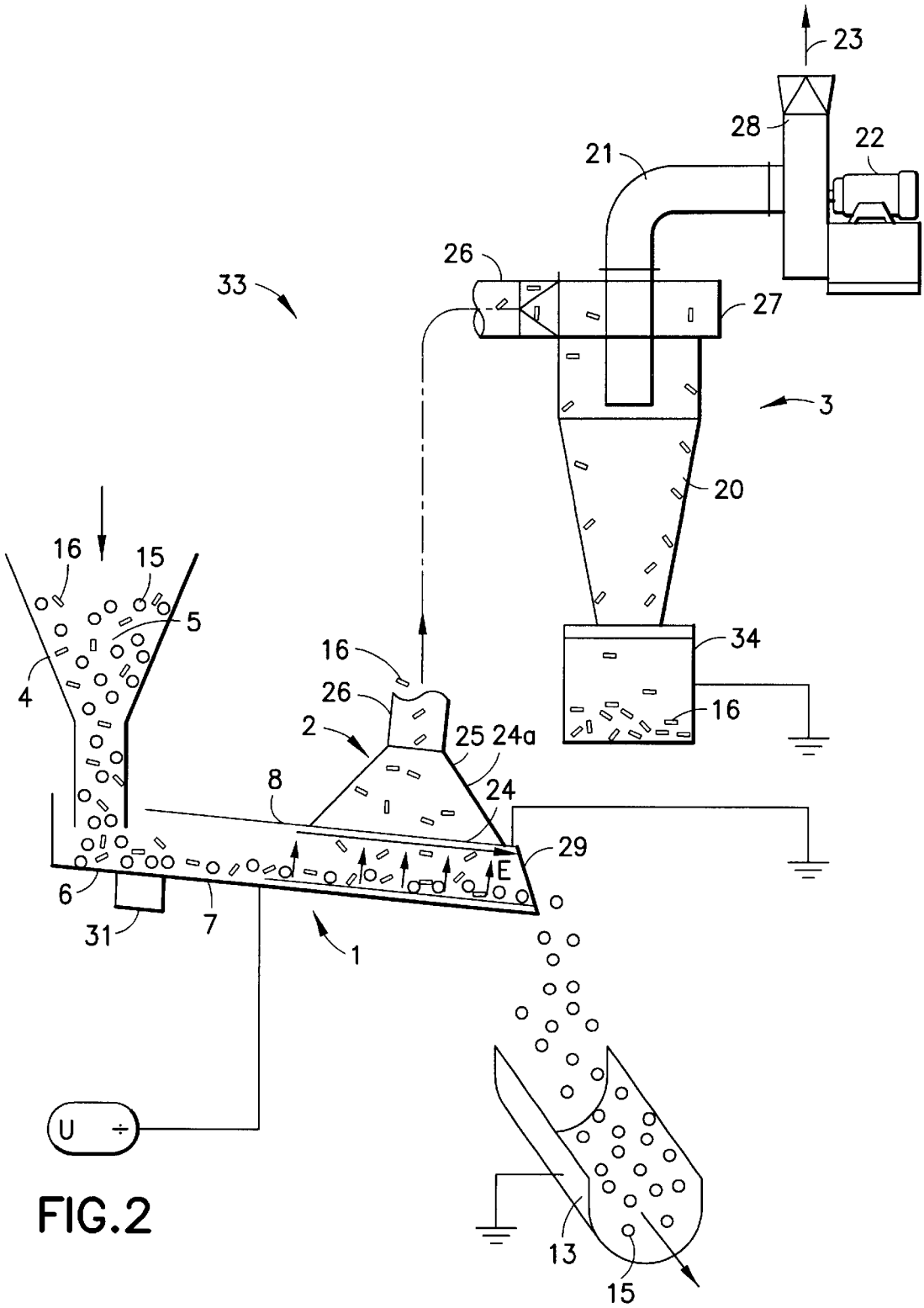
FIG. 2 is a schematic view of another apparatus for separating broken goods, also according to the invention herein.

As shown in FIG. 1, in order to accomplish the separation of the so-called nibs of broken cacao beans from the shells of the beans, the broken goods 5 are delivered in a fractionated, coarse, or dried or roasted form to a feeding hopper 4, the exit end of which delivers the material into a vibratory chute 6 provided with differently charged electrodes 7, 8 generating a homogeneous electrical field. The broken goods 5 which are to be separated is fed through the chute 6 and between the electrodes 7, 8 and are thereby electrically charged. The hopper 4 and the vibratory chute 6 together with the electrodes 7, 8 form the charging area 1 of the separating apparatus 30.

The vibratory chute 6 is provided with a vibratory drive 31, shown schematically in the drawing, which can be controlled such that a required feed speed for the broken goods are gained. Because of the fact that the hopper 4 and chute 6 can be adjusted with respect to the level on which it is installed, as indicated at "H", the feeding rate of the vibrator chute 6 may be additionally varied. The vibratory chute 6 is to the outside completely electrically insulated. Its wall 6*a* consists of plastic material into which the electrodes 7, 8 are embedded. The inner wall of the vibratory chute is moreover provided with contours in the form of protuberances or undulations 6*b*, two of which are shown schematically enlarged in FIG. 1A, supporting the mixture of the particles of the broken goods 5 moving over the protuberances and improving the charging operation of these particles provided by means of the electrodes 7, 8. In order to optimize the transfer of that charge, the generation of only one layer of particles on the bottom of the vibratory chute is intended in which all particles of the broken goods are positioned adjacent to one another and not over one another. This layer is known under the term one-particle-layer. The electrode 7 on the bottom side of the vibratory chute is connected to a DC voltage (U+) of about 20 to 40 kV and it forms the anode, whereas the second metal electrode 8 positioned directly over the electrode 7 is the cathode connected to ground and it supports the transfer of the charge to the particles of the broken goods 5.

On moving between the electrodes 7 and 8 along the chute 6 the particles of the broken goods 5, namely nibs and shells, are charged to different strength. The charge is essentially located on the surface of these particles. Thus the quantity of the transferred charge is proportional to the size of the particle surface. The rate of charging is also dependent on the electrical conductivity of the material, which is for the shells and nibs about the same.

Thus, the charging area 1 is sized according to the quantity of charge which is to be transferred to the particles, because the quantity of the electrical charge of the particles is essentially for the separation of nibs and shells later-on within a deflecting area 2 adjacent to the charging area 1.

The deflecting area 2 is provided with a downfall section 11 defined by the two electrodes 9, 10 and into which the particles of the broken goods 5 which are to be separated are delivered by the vibratory chute 6. The electrode 9 is connected to the same DC voltage (U+) as the anode 7 of the vibratrory chute, whereas the cathode electrode 10 arranged distantly adjacent thereto is connected to ground. Between the two electrodes 9, 10 exists a homogeneous electrical field E in which the deflection of the charged particles of the broken goods 5 by the forces F acting in the field is proportional to the specific charge of the particles and thus to the ratio of the quantity of charge to mass. Because of the fact the particles of the broken good, i.e. the nibs and shells, are differenty strong charged, they are deflected differently in the direction of cathode by field forces F during their downfall. In order to avoid that the shells 16, as the smaller, lighter particles and more greatly deflected particles, contact during that deflection the surface of the cathode 10 during their downfall, the cathode 10 is provided with several pass through apertures 18 having flaps 17. Behind these apertures there is a channel 19 provided with a chute 14 connected to a transport system 13 for removing the shells 16.

Because of the different deflection in the deflection area 2, the nibs 15 of the broken goods 5 are separated from the shells 16 and fall within the lower space of the downfall section 11 into the separating area 3 in which an adjustable mechanical separator 12 is located. This separator 12 is followed by the transport system 13 for the separated streams, consisting of broken cacao beans (nibs) 15 or heavier particles of broken goods 5, respectively, and cacao bean shells 16 or lighter particles of broken goods 5, respectively. The separator 12, having in the shown embodiment the configuration of a stream-separating wedge, can be shifted forwardly and backwardly along arrows S between the electrodes 9 and 10 in order to arrange for a separation of the nibs from the shells as precise as possible. This shifting operation of the separator can be made self-acting by means not shown, operating to shift the separator 12 in the direction of the arrows S.

The two electrodes 9 and 10 of the deflection area 2 are covered by an insulating layer, as otherwise contact between the charged particles of the broken good and the electrodes may cause charge transfer such that the particles jump unpredictably between the electrodes. Besides of the above mentioned charge transfer effects which are to be avoided, the mechanical rebounding of the shells 16 from the surface of the cathode 10 is avoided by the fact that this surface is provided with the flaps 17 partially defining the passage through apertures 18, through which the shells are passed so that they cannot be rebounded and thus cannot return in the space between the electrodes.

For the charging and discharging operation of the particles of the broken good and thus for the separating operation, the moisture content of the broken goods 5 is a factor as the conductivity of the material changes dependent on the moisture content of the broken goods 5 as well as for adjusting the climate in which the separating apparatus 30 is maintained for that purpose by a housing partially schematically indicated by dotted lines 32 in FIG. 1 or other suitble enclosure.

Moreover, an embodiment of the shown separating apparatus is possible consisting of several serial separators 30 in case the required effectiveness of the equipment requires such a construction. Several separating apparatuses 30 can also be operated in parallel in the same enclosure 32. Another separating apparatus 33 is shown in FIG. 2. As shown in FIG. 2, the hopper 4 contains the broken goods 5 consisting of broken cacao beans, the so-called nibs 15, and shells 16 of those beans. The broken goods 5 are delivered from the lower end of the hopper into the vibratory chute 6, provided with differently, electrically charged electrodes 7 and 8 providing a homogeneous electrical field E. The electrode 7 is located on the bottom of the chute as the electrode 8 is fixed to the roof of the chute. The broken goods 5 are moved between these electrodes towards to the outlet end 29 of the chute under the influence of vibrational of the chute, which is moving forwardly and backwardly in longitudinal direction driven by a vibratory drive 31. This drive 31 can be controlled such that the required feed speed for the broken goods within the chute 6 is gained. During this movement between the two electrodes 7 and 8, the broken goods 5 are electrostatically charged. Therefor, it can be said that the hopper 4, the vibratory chute 6 and the electrodes 7 and 8 form the charging area 1 of the separating device of FIG. 2.

The vibratory chute is completely electrically insulated to the environment. It is made of plastic material covered by metal, and the bottom side electrode 7 is embedded in the plastic material whereas the upper side electrode 8 is fixed to the roof 24 of the chute and comprises a perforated plate. The inside bottom wall of chute 6 is provided with contours in form of protuberances assisting the dispersion of the broken goods 5 running over the bottom of the chute in direction to the outlet end 29 and improving, therefore, the transfer of the electrical charges from the electrodes to the beans and shells of the broken good. The bottom side electrode 7 is connected to DC voltage of about 20–40 kV and is an anode, whereas the roof side electrode 8 is a cathode connected to ground.

During its movement between the electrodes 7 and 8, the nibs 15 and shells 16 of the broken goods 5 acquire an electrical charge of different strength. The charge is located essentially on the surface of the parts of the broken goods. Therefore, the charge transferred is proportional to the size of the surface area of those parts.

Therefore, size and configuration of the charging area 1 depend on the amount of the charge which is to be transferred to the parts of the broken goods, as the amount of the electrical charge is essential for the separation of the shells from the nibs of the broken goods. The smaller, lighter parts of the broken goods, namely the shells 16 of the beans are lifted within the vibratory chute 6 after acquiring the transfer of the electrical charge between the electrodes, as shown in the drawings, and the broken beans or nibs 15 remain essentially on the bottom of the chute. Therefore, the shells 16 exit the chute at the electrode 8 connected to ground where they become discharged and are moved through the perforations of the plate forming this electrode into the hood 24*a* of the suction apparatus 25 above the electrode 8 and the chute 6. The hood is joined through a suction tube 26 to the winnowing apparatus 27 in the form of a cyclone which is connected to a suction fan 28 by a discharge air tube 21. The lower end of the cyclone 20 is connected to a receiving container 34 for the separated shells 16.

Therefore, the winnowing apparatus 27 and the container 34 form a separating area 3 in which the shells 16 are separated from the suction air stream, whereas the area 2 adjoining the charging 1 can be designated as a deflection area where the lighter, charged shells are deflected upwardly, under influence of both charge and suction.

The air which is moved through the discharge airtube 21 by means of a suction fan 28 driven by a motor 22 is conveyed as spent air 23 to the environment.

At the outlet end 29 of the vibratory chute 6 a transport system 13 is positioned by which the broken beans 15 can be transported away for further handling.

The process according to the subject invention shows that the separation of nibs and shells by means of an electrostatic separating apparatus is possible because the forces existing in the electrical field are sufficiently high and nibs and shells distinguish sufficiently that these two portions of the broken goods can be separated from one another. The necessary voltages are in the range of 40 kV to 50 kV. By a suitable fractionation of the broken goods 5 received by the hopper 4, extremely big particles may be separated before hand in case the apparatus should not work most favorable in separating such particles. Moreover, the results of separation may be brought to an optimum by varying the distance of the electrodes, the voltage connected thereto, the polarity of the voltage as well as the quantity of feeding and the control of moisture in the nibs and shells.

Therefore, a method and apparatus for separating broken goods into nibs and shells has been described which ordinarily carries out the objects of the invention. Those skilled in the art will appreciate that certain changes may be made in the embodiments shown without departing from the spirit and scope of the invention, which is limited only by the following claims.

We claim:

1. A process for separating broken goods consisting of beans and shells comprising:

A) providing the beans and shells in fractionated condition;

B) electrostatically charging the fractionated beans and shells between two differently charged electrodes in a charging area;

C) directing the electrostatically charged fractionated beans and shells into a downfall in a homogeneous electrical field generated by two additional electrodes defining a downfall section, wherein the fractionated beans are at least partly separated from the fractionated shells by different deflection of the fractionated beans and shells in the downfall section, and wherein one of the two additional electrodes is a cathode connected to ground and provided with collection apertures having flaps, whereby lighter and smaller particles of the broken goods are so extremely deflected within the downfall section that they pass through the apertures, are prevented by the flaps from rebounding into the downfall section and are directed behind the apertures into a channel; and D) collecting the differently deflected fractionated beans and shells in a separating area providing two product streams consisting essentially of a stream of fractionated beans and a stream of fractionated shells and collecting the fractionated shells directed into the channel behind the apertures.

2. The process according to claim 1, wherein electrostatically charging the fractionated beans and shells between the charged electrodes in the charging area is carried out by supporting the fractionated beans and shells adjacent one of the electrodes and introducing into the fractionated beans and shells a vibratory movement which is controllable in order to control the speed of the fractionated beans and shells within the charging area and thus the duration of charging.

3. Process according to claim 1, wherein the electrostatically charged fractionated beans and shells are deflected within the downfall section in direction of the cathode of the two electrodes connected to ground in accordance with the quantity of the electrical charge received within the charging area.

4. The process according to claim 1, wherein the quantity of fractionated beans and shells is controlled within the charging area.

5. The process according to claim 1, wherein the moisture of the broken goods is controlled before the fractionated beans and shells enter charging area.

6. The process according to claim 1, wherein the fractionated beans and shells are spread in substantially a single layer within the charging area between the electrodes by vibratory means, thereby maximizing electrical charging of the fractionated beans and shells.

7. An apparatus for separating broken goods consisting of beans and shells, comprising:

A) means for supplying fractionated beans and shells of the broken goods;

B) a charging area including two differently charged electrodes and adapted to pass the fractionated beans between the two differently charged electrodes, thereby imparting an electrostatic charge to the fractionated beans and shells;

C) a deflecting area receiving the electrostatically charged fractionated beans and shells from the charging area, the deflecting area including and defining a downfall section between an additional two differently changed electrodes, the electric field between the additional two differently charged electrodes deflecting the fractionated beans and shells into a product stream of primarily smaller, lighter and more greatly deflected fractionated shells and a product stream of primarily larger, heavier and less deflected fractionated beans, wherein one of the additional two electrodes defining the deflection area is cathode connected to ground and is provided with several apertures having flaps assisting in the removal of the deflected fractionated shells passing through the apertures; and D) a separating area receiving the deflected fractionated beans and shells from the deflection area and separately collecting the product stream of larger, heavier fractionated beans and the product stream of primarily smaller, lighter broken shells.

8. Apparatus according to claim 7, wherein the means for supplying fractionated broken beans and shells is at least one feeding hopper for receiving the fractionated broken beans and shells which are to be separated and the charging area is provided with at least one vibratory chute receiving the fractionated broken beans and shells from the feeding hopper, which chute is provided with the differently charged electrodes generating a homogeneous electrical field between which the fractionated broken beans and shells are passed to become electrostatically charged, wherein moreover the separating area is provided with at least one adjustable mechanical separator connected to a transport system for the separated product streams, consisting of heavier fractionated beans and lighter fractionated shells.

9. Apparatus according to claim 8, wherein a channel is provided behind the apertures connected to the transport system for the removal of the fractionated shells.

10. Apparatus according to claim 8, wherein one of the two electrodes of the vibratory chute is a cathode connected to ground, thereby supporting the transfer of charge to the fractionated beans and shells.

11. Apparatus according to claim 8, wherein the at least one vibratory chute is provided with an adjustable vibratory drive.

12. Apparatus according to claim 8, wherein the feeding hopper is adjustably positioned with respect to the vibratory chute.

13. Apparatus according to claim 8, wherein the vibratory chute is completely electrically insulated to the outside.

14. Apparatus according to claim 8, wherein the electrodes of the charging area are metal embedded into the vibratory chute, the vibratory chute including plastic insulating material.

15. Apparatus according to claim 8, wherein the vibratory chute has an inside wall provided with contours, thereby providing for improving the transfer of electrical charge to the fractionated beans and shells passing thereover.

16. Apparatus according to claim 15, wherein the contours are in the form of protuberances.

17. Apparatus according to claim 8, wherein one of the electrodes of the charging area is an anode and one of the electrodes of the deflecting area is an anode and the said anodes are both connected to a DC voltage with the same polarity with respect to ground.

18. Apparatus according to claim 8, wherein the two electrodes defining the downfall section of the deflection area are metal plates covered with an electrically insulating layer of material in order to avoid transfer of electrical charge to fractionated beans and shells coming into contact therewith.

19. Apparatus according to claim 8, wherein the fractionated beans and shells are provided having a controlled moisture content.

20. Apparatus according to claim 8, and further comprising an enclosure.

21. Apparatus according to claim 20, wherein the enclosure is climate controlled.

22. Apparatus according to claim 8, provided in one of multiple, serial sequence to form a multi-stage separating equipment or multiple parallel deployment for the separation of different fractions of particles.

* * * * *

UNITED STATES PATENT AND TRADEMARK OFFICE

CERTIFICATE OF CORRECTION

PATENT NO. : 6,359,246 B1 
DATED : March 19, 2002
INVENTOR(S) : Joachim Essig and Olaf Oehmichen It is certified that error appears in the above-identified patent and that said Letters Patent is hereby corrected as shown below:

Column 2,
Line 22, “basic” should be -- basis --
Line 42, “subjeted” should be -- subjected --

Column 4,
Line 36, “nipbs” should be -- nibs --
Line 50, “atre” should be -- are --

Column 6,
Line 17, “differenty” should be -- differently --
Line 63, “suitble” should be -- suitable --

Column 7,
Line 19, “Therefor” should be -- therefore --
Line 20, after “the” -- two -- should be inserted.

Signed and Sealed this

Tenth Day of September, 2002

*Attest:*

*Attesting Officer*

JAMES E. ROGAN
*Director of the United States Patent and Trademark Office*